US006788323B2

(12) United States Patent
Enomoto et al.

(10) Patent No.: US 6,788,323 B2
(45) Date of Patent: Sep. 7, 2004

(54) PRINTER

(75) Inventors: Hisashi Enomoto, Saitama (JP); Kouichi Hirasawa, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/454,532

(22) Filed: Jun. 5, 2003

(65) Prior Publication Data

US 2003/0227534 A1 Dec. 11, 2003

(30) Foreign Application Priority Data

Jun. 7, 2002 (JP) ..... 2002-167938

(51) Int. Cl.[7] ..... B41J 2/325
(52) U.S. Cl. ..... 347/177

(58) Field of Search ..... 347/177, 171, 347/172, 175; 399/74

(56) References Cited

FOREIGN PATENT DOCUMENTS

| | | |
|---|---|---|
| JP | 07-288459 A | 10/1995 |
| JP | 09-272217 A | 10/1997 |

*Primary Examiner*—K. Feggins
(74) *Attorney, Agent, or Firm*—Sughrue Mion, PLLC

(57) ABSTRACT

Illumination adjustment of LEDs is carried out prior to printing to a color thermosensitive recording paper with each thermosensitive coloring layer of yellow, magenta, and cyan. A light control circuit lights on the LEDs by one line printing period upon printing to each thermosensitive coloring layer, and makes CCD line sensors use its reflected light to image lateral edge of the color thermosensitive recording paper. Consequently, the output signal from the CCD line sensors is set within the linearity.

13 Claims, 6 Drawing Sheets

PRINTER

BACKGROUND OF THE INVENTION

1. Field of the Invention

The present invention relates to a printer, in particular, a printer that detects lateral edges of a recording paper to realize margin-free printing.

2. Explanations of the Prior Arts

Due to the wide usage of digital still camera, demand for color printing of the photographed image is on the increase. A color thermosensitive printer is used for color printing. The color thermosensitive printer presses a heating element array of a thermal head to a color thermosensitive recording paper with yellow, magenta, and cyan thermosensitive coloring layers on a substrate, so that the three thermosensitive coloring layers successively develop their respective color, to form a full-color image. It is preferable to have a marginless printing to make the most of a recording area, as well as making the appearance of the color printing better. In this case, the heating element array must be wider than the color thermosensitive recording paper to record the lateral edge of the color thermosensitive recording paper without fail. Heating the heating element that does not touch the color thermal recording paper causes "wasted heating", which shortens the life of the heating element. In order to prevent this, JPA No. 9-272217 discloses a printer that applies inspection light to a lateral edge portion of a color thermosensitive recording paper. A CCD line sensor detects inspection light reflected at the color thermosensitive recording paper, so that the lateral edge is detected. The detection error range is increased when the illuminance of the light source is high beyond a range of linearity of the CCD line sensor, or low enough to be affected by a dark electrical current and a noise.

In order to detect the edge position of the color thermal recording paper precisely, it is necessary to set the illuminance of the light source within a range of linearity of the CCD line sensor. It is also necessary to keep the illuminance of the light source at a regular level as an output level from the CCD line sensor is changed in accordance with the intensity of illumination. Moreover, an electrical charge storage period must be kept constant because an output from the CCD line sensor is increased or decreased when the electrical charge storage period is long or short. However, fluctuation in illuminance in the light source make it difficult to keep the output level of the CCD line sensor within the linearlity.

The printing period for each line is different in accordance with the sensitivity of the thermosensitive coloring layers. Due to the difference in the printing period, the electrical charge storage period is changed in printing to each thermosensitive coloring layer. Furthermore, reflectance of the thermosensitive recording paper changes in accordance of the type, such as a normal type and a seal type. Thus, the output level of the CCD line sensor is changed, which makes it difficult to detect lateral edges of the color thermal recording paper precisely.

SUMMARY OF THE INVENTION

An object of the present invention is to detect the lateral edge of a recording paper precisely by keeping an output of a sensor at a certain level within its linearlity.

To attain the above object, the printer of the present invention is provided with a light control circuit and a control means.

The light control circuit controls illumination of inspection light irradiated from the light source based on the output signal level from the sensor. And the control means detects a lateral edge of a recording paper on receiving a signal from the CCD line sensor, and records an image by driving plural recording elements in contact with the recording paper in a main scanning direction.

In the preferred embodiment, the sensor is a CCD line sensor in which plural pixels are arranged along the main scanning direction. The control means detects the lateral edge of the recording paper by comparing the output signal level from the pixels. The light control circuit conducts illumination adjustment of inspection light prior to recording the image. The light control circuit fixes a target output value of the output signal level to change illumination of inspection light so that the output signal level from the pixel becomes close to the target output value. At this time, the light control circuit detects the signal from each pixel by a one line recording period for recording the image by one line.

As the output signal level from the CCD line sensor is kept constant in this way, the lateral edge of the color thermosensitive paper can be detected precisely.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
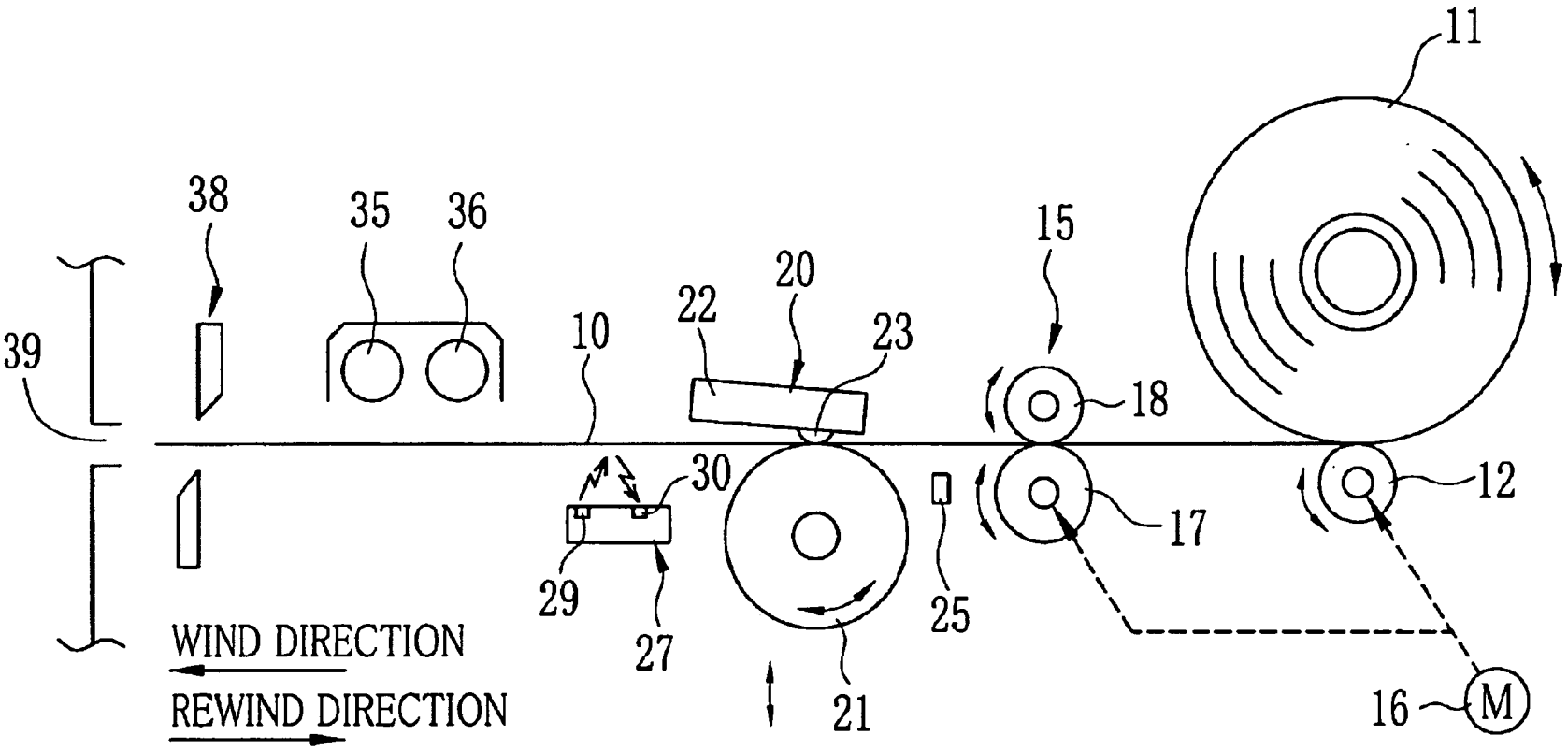
FIG. 1 is a schematic view illustrating a color thermosensitive printer.

FIG. 1 shows a color thermosensitive printer in which the present invention is applied. A color thermosensitive recording paper 10 as a recording medium is rolled to be a recording paper roll 11, which is set in the color thermosensitive printer. A paper-supply roller 12 contacts the outer surface of the recording paper roll 11 and rotates it to convey the color thermosensitive recording paper 10 back and forth.

Figure 2:
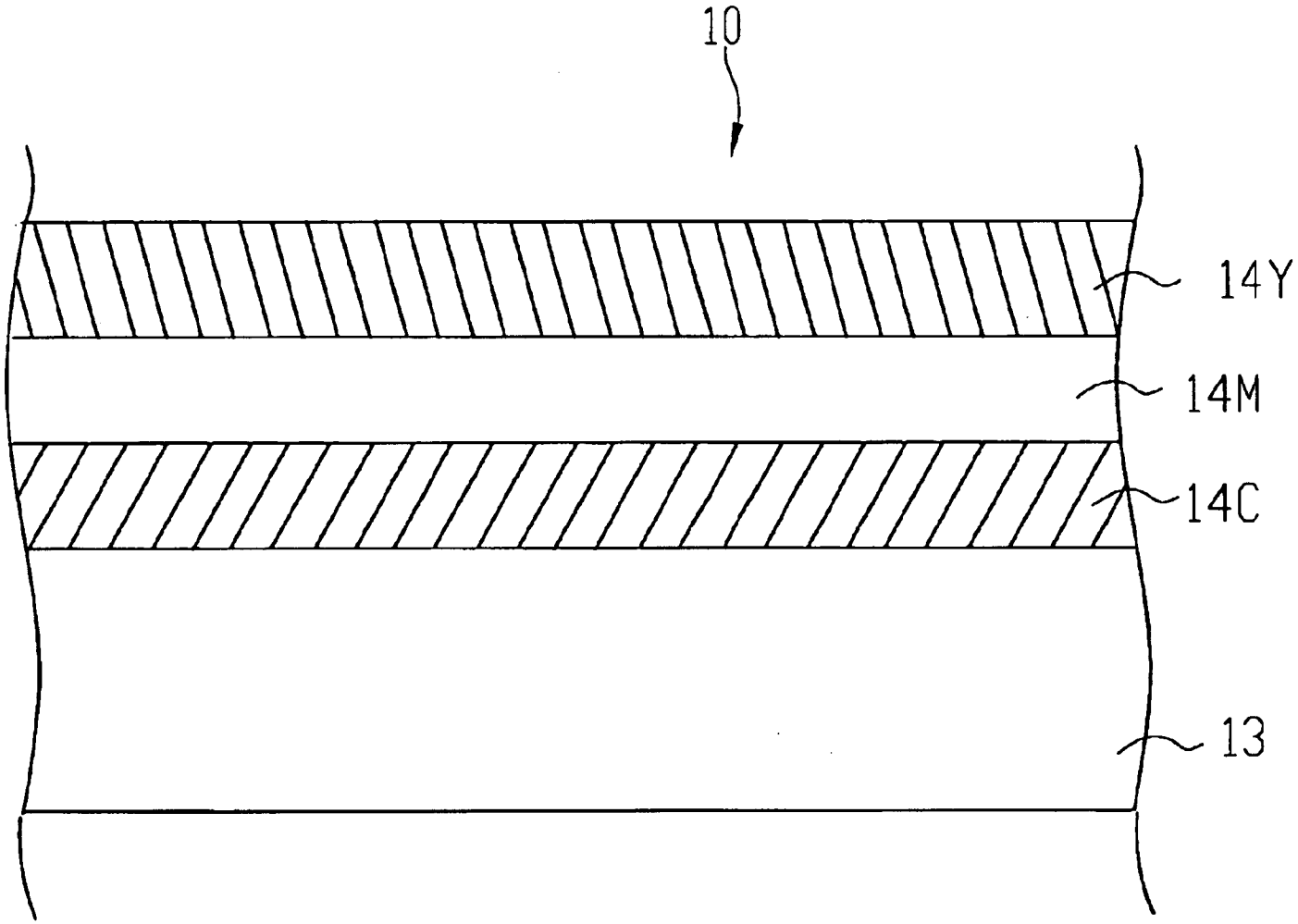
FIG. 2 is a cross section illustrating a part of the color thermosensitive recording paper.

As shown in FIG. 2, the color thermosensitive recording paper 10 has a cyan thermosensitive coloring layer 14C, a magenta thermosensitive coloring layer 14M, and a yellow thermosensitive coloring layer 14Y on a substrate 13. A transparent protective layer (not shown) is on the yellow thermosensitive coloring layer 14Y. Each thermosensitive coloring layer has respectively different sensitivity so as to make each thermosensitive coloring layer develop its color selectively. The yellow thermosensitive coloring layer 14Y of top layer has the highest sensitivity, for developing yellow by small heat energy. Meanwhile, the cyan thermosensitive coloring layer 14C of bottom layer has the lowest sensitivy, for developing cyan by large heat energy. The yellow thermosensitive coloring layer 14Y loses the coloring ability when near ultraviolet rays with a wavelength peak of 420 nm is emitted. And the magenta thermosensitive coloring layer 14M, which develops the magenta by heat energy between the yellow thermosensitive coloring layer 14Y and the cyan thermosensitive coloring layer 14C, loses the coloring ability when near ultraviolet rays with a wavelength peak of 365 nm is emitted.

In FIG. 1, a convey roller pairs 15 is provided in the downstream side for conveyance of the recording paper roll 11. The convey roller pairs 15 consists of a capstan roller 17 and a pinch roller 18 that nip the color thermosensitive recording paper 10 when a convey motor 17 is driven. The convey roller pairs 15 is rotated to convey the color thermosensitive recording paper 10 in a wind and rewind direction shown in the drawing.

A thermal head 20 and a platen roller 21 are disposed on the downstream side from the convey roller pairs 15 so as to nip the conveyance path of the color thermosensitive recording paper 10. The thermal head 20 has a head plate 22 of high heat conductivity metal, under which plural heating element arrays 23 are arranged in a line along a main scanning direction perpendicular to the wind direction. A heating element array 23 is arranged longer than the width of the color thermosensitive recording paper 10 in order to print the whole area in the width direction of the color thermosensitive recording paper 10. When the color thermosensitive recording paper 10 is conveyed in the rewind direction by the convey roller pairs 15, the thermal head 20 heats each heating element of the heating element array 23 to develop color in each thermosensitive coloring layer. The platen roller 21 below the thermal head 20 in the drawing is movable up and down, and biased by a spring (not shown) at a nip direction to press the thermal head 20. At the nip position, the platen roller 21 follows to rotate in accordance with conveyance of the color thermosensitive recording paper 10, for supporting to press the color thermosensitive recording paper 10 with the heating element array 23.

Since the thermosensitive coloring layer of yellow, magenta, and cyan has respectively different heat sensitivity, the drive time of the heating element is different according to color. Therefore, in accordance with heat sensitivity of each thermosensitive coloring layer, the one line printing period for printing a single line follows as yellow printing<magenta printing<cyan printing. A leading edge sensor 25 is between the convey roller pairs 15 and the platen roller 21 to detect the head of the color thermosensitive recording paper 10 upon paper supply. A photo interrupter having a light projector and a light detecter is used as the leading edge sensor 25. The light projector emits light to the color thermosensitive recording paper 10. The light detector detects light reflected at the color thermosensitive recording paper 10 to detect the leading edge.

Figure 3:
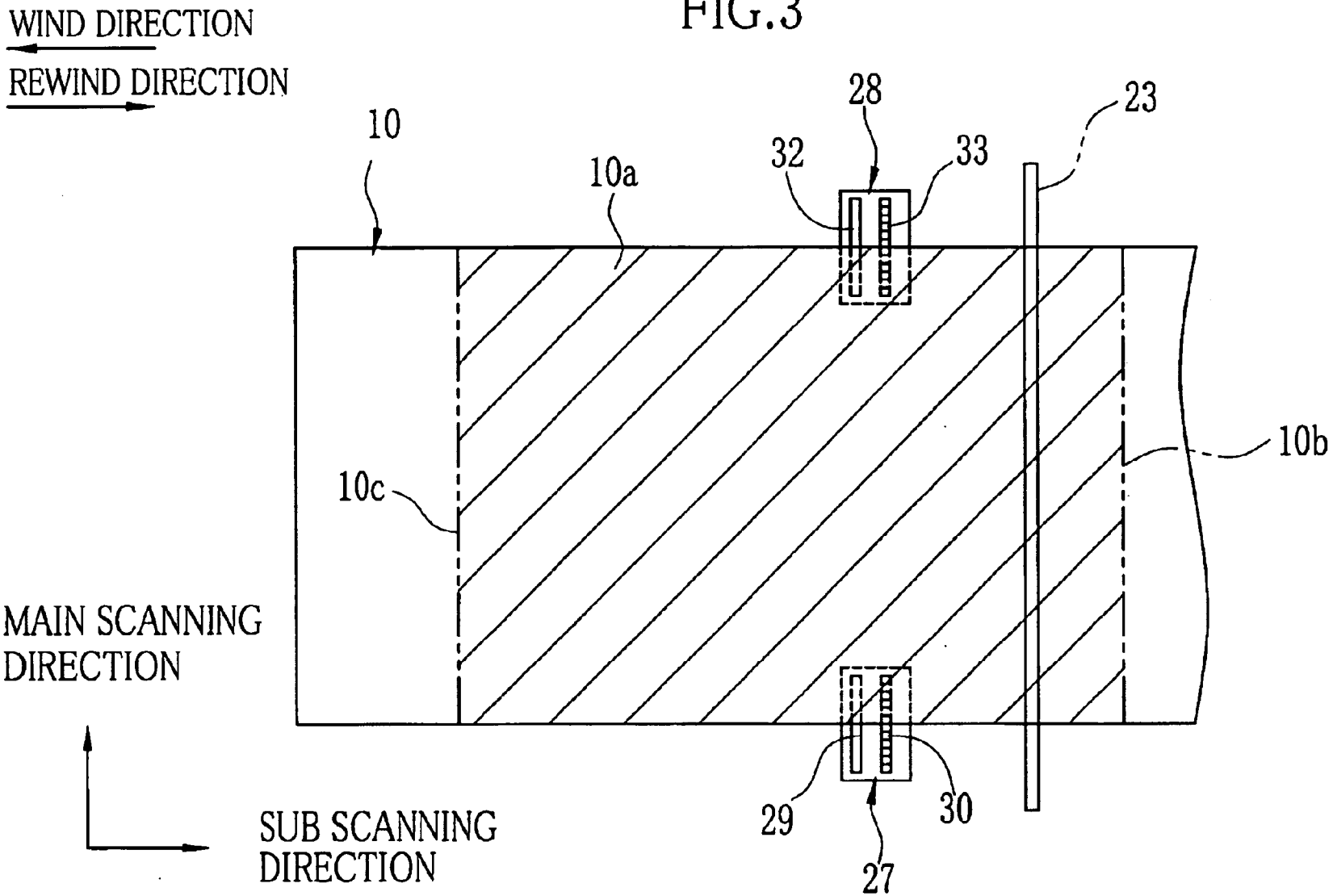
FIG. 3 is a front view illustrating a conveyance path of the color thermosensitive recording paper.

Lateral edge sensors 27 and 28 to detect both lateral edges of the color thermosensitive recording paper 10 are arranged downside of the conveyance path and on the downstream side from the thermal head 20 in a wind direction. As shown in FIG. 3, the lateral edge sensor 27 has a linear LED 29 and a CCD line sensor 30. The LED 29 projects inspection light to a lateral edge portion of the color thermosensitive recording paper 10. The CCD line sensor 30 has plural pixels arranged at an approximately equal pitch with the heating element on a base. Output signal level of a pixel is high when the pixel detects inspection light reflected at the color thermosensitive recording paper 10. On the other hand, output signal level is low when the pixel does not detect reflected light. Therefore, it is possible to detect the lateral edge of the color thermosensitive recording paper 10 by comparing the output signal level from each pixel of the CCD line sensor 30. The LED 29 and the CCD line sensor 30 are arrranged so that its longitudinal direction is approximately parallel to the main scanning direction. This makes it possible to detect the lateral edge of the color thermosensitive recording paper 10 even when the color thermosensitive recording paper 10 is tilted. Note that it is possible to arrange plural small LEDs in the main scanning direction, although a single linear LED 29 is provided in the above embodiment. The lateral edge sensor 28 has a LED 32 and a CCD line sensor 33 that are same as those of the lateral edge sensor 27.

In FIG. 1, the yellow fixation lamp 35 and the magenta fixation lamp 36 that consist a fixing light device are disposed on the downstream side from the thermal head 20 in a wind direction. The yellow fixation lamp 35 applies near ultraviolet rays having a wavelength peak at around 420 nm, to fix the yellow thermosensitive coloring layer of the thermosensitive recording paper 10. The magenta fixation lamp 36 applies near ultraviolet rays having a wavelength peak at around 365 nm, to fix the magenta thermosensitive coloring layer of the color thermosensitive recording paper 10. A cutter 38 is disposed on the downstream side from the yellow fixation lamp 35 in a wind direction. The cutter 38 cuts the color thermosensitive recording paper 10 by each recording area to make a cut sheet. A paper outlet 39, disposed on the downstream side from the cutter 38, ejects the cut sheet outside of the color thermosensitive printer.

Figure 4:
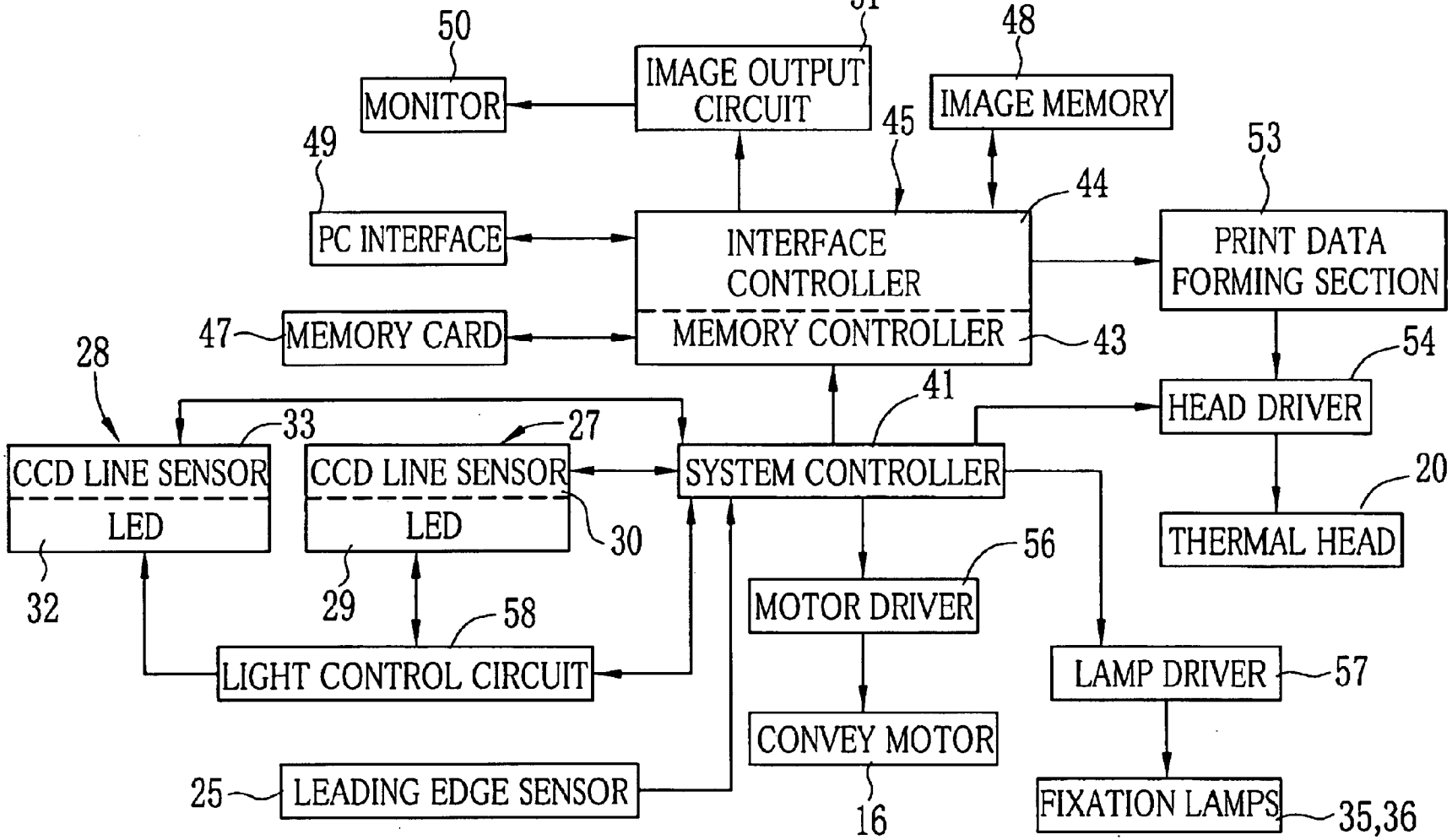
FIG. 4 is a block view illustrating structure of the color thermosensitive printer.

As shown in FIG. 4, the color thermosensitive printer, the color thermosensitive printer of the present embodiment is integrally controlled by a system controller 41, which consists of a CPU, a program ROM, a work RAM, and so forth, for instance. In order to control the whole printer, the CPU controls each section of the color thermosensitive printer in accordance with the control program stored in the program ROM and stores data temporarily in the work RAM. The system controller 41 connects an IC 45 in which the memory controller 43 and an interface controller 44 are loaded. The memory controller 43 controls a memory card 47 inserted into a memory card slot provided outside the color thermosensitive printer and an image memory 48, for reading and writing image data. The interface controller 44 controls a PC interface 49 to connect with a personal computer and a digital camera, and an image output circuit 51 to output an image to a monitor 50. For instance, in case image data stored in the memory card 47 is displayed on the monitor 50, image data is read out by the memory controller 43, and inputted to the image output circuit 51 by the interface controller 44. The image output circuit 51 converts image data of RGB format to a composit signal of NTSC format, then outputs it to the monitor 50. Printing the image, image data in the memory card 47 is read out by the memory controller 43 and stored in the image memory 48. The memory controller 43 reads image data in the image memory 48, and sends it to a print data forming section 53, where image data of RGB format is converted to the print data of YMC format. Print data is inputted to a head driver 54 by a single line for each color. The head driver 54 converts print data to drive signals to drive each heating element of the thermal head 20.

A motor driver 56 and a lamp driver 57 are connected to the system controller 41. In receipt of a control signal from the system controller 41, the motor driver 56 generates a drive pulse to drive the convey motor 16. The convey motor 16 is a step motor. The system controller 41 counts the drive pulse to detect the conveyance amount of the color thermosensitive recording paper 10. In response to a control signal from the system controller 41, the lamp driver 57 lights on and lights off the yellow fixation lamp 35 and the magenta fixation lamp 36 to fix the yellow thermosensitive coloring layer 14Y and the magenta thermosensitive coloring layer 14M respectively. The light control circuit 58 is also connected to the system controller 41. The light control circuit 58 conducts illumination adjustment which sets an illumination control value to control the illuminance of inspection light from the LEDs 29 and 32. For example, the illumination control value has 512 grades, including non illumination state of the LEDs 29 and 32. Note that the light control circuit 58 carries out illumination adjustment prior to printing to each thermosensitive coloring layer.

Figure 5:
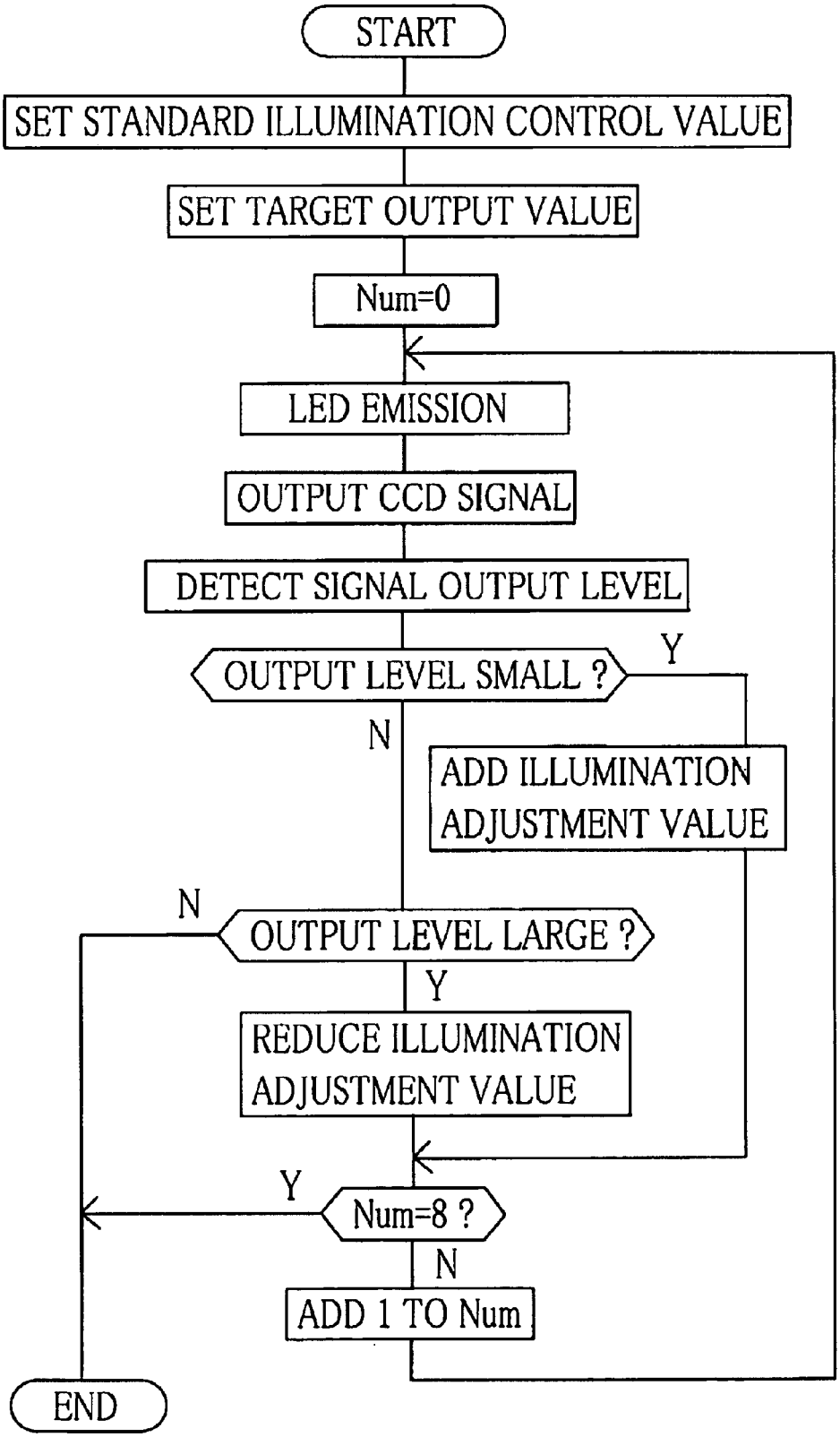
FIG. 5 is a flow chart showing illumination adjustment process.

The process of illumination adjustment is shown in FIG. 5. After initializing a count number Num to "1", the light control circuit 58 sets an output level within a linearity of the CCD line sensors 30 and 33 (for instance, an output signal level of center value of linearity) as a target output value. Then, a standard illumination control value (for example "256") is set as illumination control value of the LEDs 29 and 32 to illuminate the LEDs 29 and 32 by the standard illumination. The lateral edge location of the color thermosensitive recording paper 10 in the main scanning direction is detected by comparing output signal level of each pixel of the CCD line sensors 30 and 33. Output signal level of each pixel is changed depending upon the electrical charge storage period. The electrical charge storage period is determined by the one line printing period. In order to keep output signal level at a predetermined level, the illuminance control value for each color is adjusted in accordance with the one line printing period of each color.

The light control circuit 58 detects a high output signal level and a low output signal level by comparing output levels from all pixels of the CCD line sensors 30 and 32. And the light control circuit 58 compares the output signal level with a target output value. In case the output signal level is high, the adjustment value in the table shown below is reduced from the illumination control value. Meanwhile, in case the output signal level is low, the adjustment value is added to the illumination control value. The adjustment value is determined in accordance with the count value Num.

TABLE 1

| | |
|---|---|
| standard illumination control value | 256 |
| first illumination adjust value | 128 |
| second illumination adjust value | 64 |
| third illumination adjust value | 32 |
| fourth illumination adjust value | 16 |
| fifth illumination adjust value | 8 |
| sixth illumination adjust value | 4 |
| seventh illumination adjust value | 2 |
| eighth illumination adjust value | 1 |

After illumination control value is changed, "1" is added to the count value Num. The LEDs 29 and 32 are driven to discharge inspection light based on changed illumination control value. The CCD line sensors 30 and 33 detect reflected inspection light. Output level of the CCD line sensors 30 and 31 is compared with the target output value in order to amend the illumination control value. A preferable illumination control value is obtained by repeatedly conducting such process 8 times at maximum. The output level of the CCD line sensors 30 and 33 is approximately correspondent with the target output value at this time.

Figure 6:
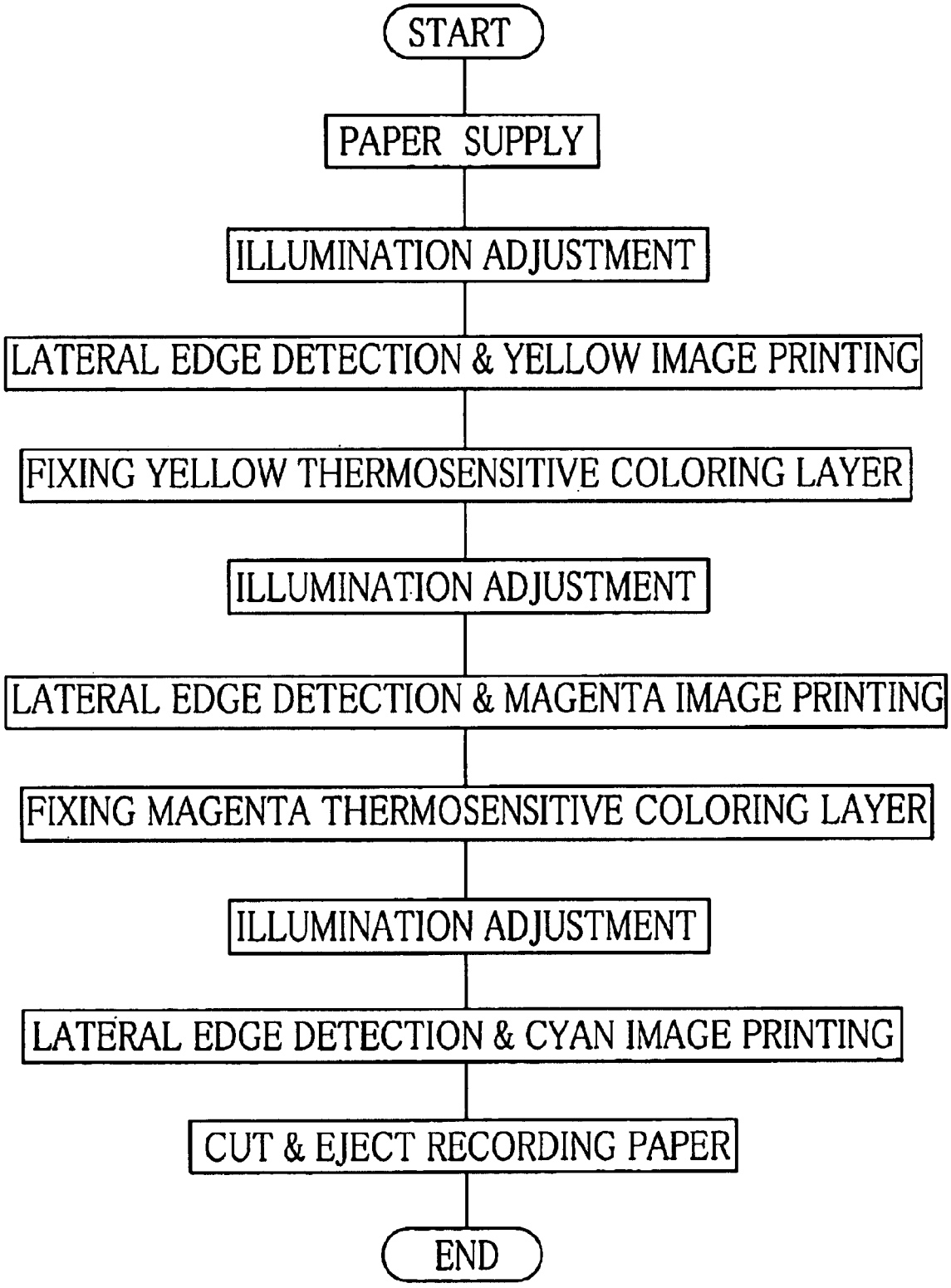
FIG. 6 is a flow chart showing operation of the color thermosensitive printer.

The operation of the above embodiment of the present invention is described in reference to the flow chart shown in FIG. 6. The memory controller 43 reads image data stored in the memory card 47, and sends it to the image output circuit 51. The image is displayed on the monitor 50. A user selects an image displayed on the monitor 50 for printing. When print command is inputted, the system controller 41 controls the motor driver 52 to rotate the convey motor 16, which rotates the paper supply roller 12 counterclockwise in the drawing of FIG. 1. The leading edge of the color thermosensitive recording paper 10 is fed toward the conveyance path.

The leading edge sensor 25 sends edge detection signal to the system controller 41 when the leading edge of the color thermosensitive recording paper 10 passes the leading edge sensor 25. In response to the edge detection signal, the system controller 41 starts counting the drive pulse inputted from the motor driver 56 to the convey motor 16 in order to specify the conveyance amount of the color thermosensitive recording paper 10.

When a printing start position lob in a recording area 10*a* (hatching area in the FIG. 3) is conveyed to the detecting position of the lateral edge sensors 27 and 28 by counting the number of the drive pulse, the system controller 41 stops rotating the convey motor 16 to complete paper supply. The pinch roller 18 is moved by a shift mechanism (not shown) to cooperate with the capstan roller 17 to nip the color thermosensitive recording paper 10. Similarly, the platen roller 21 is moved by a shift mechanism (not shown) to cooperate with the heating element array 23 to nip the color thermosensitive recording paper 10.

The system controller 41 controls the light control circuit 58 so that illumination of inspection light is adjusted for the yellow printing. The light control circuit 58 sets the standard illumination control value "256" to illuminate the LEDs 29 and 32 at the standard illumination. The CCD line sensors 30 and 33 image the lateral edges of the color thermosensitive recording paper 10 by the one line printing period upon yellow printing. Output signal is sent to the system controller 41. Based on the output signal from the CCD line sensors 30 and 33, the light control circuit 58 adds or reduces the adjustment value shown in Table 1 to correct illumination adjustment value. For instance, in case the target output value of the CCD line sensors 30 and 33 is "373", the illumination value is adjusted as follows; first time: addition, second time: reduction, the third time: addition, the fourth time: addition, the fifth time: addition, the sixth time: reduction, the seventh time: addition, the eighth time: reduction. The light control circuit 58 sets the target illumination control value "373" in this manner.

After completion of illumination adjustment, the system controller 41 rotates the convey motor 16 to convey the color thermosensitive recording paper 10 in the rewind direction. During this conveyance in the rewind direction, the lateral edge sensors 27 and 28 detect both lateral edges of the color thermosensitive recording paper 10. The lateral edge is detected with high precision because the illumination level of the LEDs 29 and 32 is adjusted to be within a range of linearity of the output signal level from the CCD line sensors 29 and 32. Moreover, the system controller 41 controls the head driver 54 to heat each heating element of the heating element array 23 of the thermal head 20, so that the frameless yellow image is printed in the recording area 10*a*. At that time, the system controller 41 does not drive the heating element that is not in contact with the color thermosensitive recording paper 10, namely, that locates outside the both lateral edges. It is possible to prevent so-called "wasted heating", and to extend the life of the heating element array.

When the yellow image is printed to the print completion position 10*c* in the recording area 10*a*, the sytem controller 41 stops conveying the color thermosensitive recording paper 10 in a rewind direction. And a shift mechanism (not shown) moves the platen roller 26 to release the color thermosensitive recording paper 10. The system controller 41 rotates the convey motor 16 to convey the color thermosensitive recording paper 10 in a wind direction. In symchronism with this, the system controller 41 controls the lamp driver 57 to light on the yellow fixation lamp 35, for conducting fixation of the printed yellow thermosensitive coloring layer 14Y.

When the ultraviolet rays is applied to the printing start position 10*b* of the recording area 10*a* to complete fixation of the yellow thermosensitive coloring layer 14Y, the system controller 41 stops conveying the color thermosensitive recording paper 10 and lights off the yellow fixation lamp 35. The system controller 41 conveys the color thermosensitive recording paper 10 in a rewind direction. When the printing start position 10*b* of the recording area 10*a* is reached to the detecting position by the edge sensors 27 and 28, the system controller 41 stops the conveyance. Then, the system controller 41 moves the platen roller 21 to press the color thermosensitive recording paper 10.

The light control circuit 58 conducts the illumination adjustment of inspection light to set a suitable illumination control value for magenta image printing. The illumination adjustment is carried out in the same way as the illumination adjustment for yellow image printing, such that the imaging period is the one line printing period in magenta printing. Upon completion of the illumination adjustment for magenta image printing, the system controller 41 starts conveying the color thermosensitive recording paper 10 in a rewind direction again. During this conveyance, the lateral edge sensors 27 and 28 detect both lateral edges of the color thermosensitive recording paper 10 in the main scanning direction to print the marginless magenta image in the recording area 10*a*.

Upon completion of printing of the magenta image to the recording area 10*a*, the sytem controller 41 stops conveyance in the rewind direction, and the platen roller 26 releases the color thermosensitive recording paper 10. And the system controller 41 conveys the color thermosensitive recording paper 10 in a wind direction and lights on the magenta fixation lamp 36 to fix the printed magenta thermosensitive coloring layer 14M. Upon completion of fixation of the magneta thermosensitive coloring layer 14M, the system controller 41 stops conveying the color thermosensitive recording paper 10 and lights off the magenta fixation lamp 36. During a stop of this conveyance, the platen roller 21 presses the color thermosensitive recording paper 10.

Similarly, the light control circuit 58 conducts the cyan illumination adjustmemt of inspection light for cyan image printing. Illumination of inspection light is adjusted under the condition that the charge storage period of the CCD line sensors 30 and 33 is the one line printing period of the cyan image printing. After illumination is adjusted, the system controller 41 starts conveyance of the color thermosensitive recording paper 10 in a rewind direction again. During this conveyance, the lateral edge sensors 27 and 28 detect both lateral edges of the color thermosensitive recording paper 10 in the main scanning direction as well as printing the cyan image. After recording the cyan image, the color thermosensitive recording paper 10 is conveyed in a wind direction and cut into a cut sheet. The cut sheet is ejected from the paper outlet 39 outside the color thermosensitive printer.

According to the above embodiment, the standard illumination control value is set as "256" and the number of illumination control value upon modification is set as 8 to realize the 512-grade illumination adjustment. It is not limited to this number, but changeable appropriately in accordance with the type of the light source of inspection light.

Besides that, the CCD line sensors and the LEDs may be disposed to face each other across the conveyance path of the color thermosensitive recording paper although they are integrally formed in the above embodiment. It is also possible to form the CCD line sensor and the LED only on one lateral side of the conveyance path.

In addition to a color thermosensitive printer, it is possible to apply the present invention to various printers, such as a monochrome thermosensitive printer, thermosensitive printers of sublimation type and heat metling type, an ink jet printer, a laser printer, a light printer and so forth.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer having a recording head with plural recording elements being arranged in a main scanning direction, for recording an image line by line while conveying a recording paper in a sub scanning direction, said printer comprising:

a light source for emitting inspection light to at least one lateral edge portion of said recording paper, a sensor for receiving said inspection light, said sensor outputting a signal to detect a lateral edge of said recording paper in said main scanning direction; and a light control circuit for controlling illumination of said inspection light irradiated from said light source based on an output signal level of said sensor.

2. A printer as claimed in claim 1, further comprising:

control means for detecting said lateral edge of said recording paper in receipt of said signal from said sensor, said control means recording said image by driving said recording elements in contact with said recording paper in said main scanning direction.

3. A printer as claimed in claim 2, wherein said sensor is a CCD line sensor in which plural pixels are arranged along said main scanning direction, and said control means detects said lateral edge of said recording paper by comparing the output signal level from said pixels.

4. A printer as claimed in claim 3, wherein said light control circuit conducts illumination adjustment of said detection light prior to recording said image.

5. A printer as claimed in claim 3, wherein said light control circuit detects said signal from each pixel by a one line recording period for recording said image by one line.

6. A printer as claimed in claim 3, wherein said light control circuit fixes a target output value of the output signal level to change illumination of said detection light so that the output signal level from said pixel becomes close to said target output value.

7. A printer having a thermal head with plural recording elements being arranged in a main scanning direction, for recording an image to each of plural thermosensitive coloring layers line by line while conveying a thermosensitive recording paper in a sub scanning direction, said printer comprising:

a light source for irradiating inspection light to at least one lateral edge of said thermosensitive recording paper;

a sensor for receiving said detection light, said sensor outputting a signal to detect a lateral edge of said thermosensitive recording paper in said main scanning direction; and a light control circuit for controlling illumination of said inspection light irradiated from said light source based on an output signal level of said sensor.

8. A printer as claimed in claim 7, further comprising control means for detecting said lateral edge of said thermosensitive recording paper by said signal from said sensor, said control means recording said image by driving said recording elements in contact with said thermosensitive recording paper in said main scanning direction.

9. A printer as claimed in claim 8, wherein said sensor is a CCD line sensor in which plural pixels are arranged along said main scanning direction, said control means detects said lateral edge of said recording paper by a change of the output signal level of each pixels.

10. A printer as claimed in claim 9, wherein said light control circuit controls illumination prior to recording said image onto said respective thermosensitive coloring layer.

11. A printer as claimed in claim 10, wherein said light control circuit detects said signal of each pixel by one line recording period for each thermosensitive coloring layer.

12. A printer as claimed in claim 11, wherein said plural thermosensitive coloring layers are cyan, magenta, and yellow thermosensitive coloring layers, said one line recording period is lengthened in order of said yellow thermosensitive coloring layer, said magenta thermosensitive coloring layer, and said cyan thermosensitive coloring layer.

13. A printer as claimed in claim 10, wherein said light control circuit sets a target output value of the output level to change illumination of said detection light in order that the output signal level from said pixel comes close to said target output value.

* * * * *